US008113360B2

(12) United States Patent
Olson

(10) Patent No.: US 8,113,360 B2
(45) Date of Patent: Feb. 14, 2012

(54) PRODUCT SHELF DIVIDER SYSTEM AND METHOD

(76) Inventor: Carl Olson, College Station, TX (US)

( * ) Notice: Subject to any disclaimer, the term of this patent is extended or adjusted under 35 U.S.C. 154(b) by 654 days.

(21) Appl. No.: 12/286,251

(22) Filed: Sep. 29, 2008

(65) Prior Publication Data

US 2009/0101606 A1 Apr. 23, 2009

Related U.S. Application Data

(63) Continuation-in-part of application No. 11/381,587, filed on May 4, 2006, now abandoned.

(60) Provisional application No. 61/190,267, filed on Aug. 27, 2008.

(51) Int. Cl.
*A47F 1/00* (2006.01)

(52) U.S. Cl. ..... 211/59.3

(58) Field of Classification Search ..... 211/51, 211/59.1, 59.2, 59.3, 59.4, 175, 184; 108/60, 108/61; 312/35, 42, 45, 61, 71; 221/227, 221/255, 279

See application file for complete search history.

(56) References Cited

U.S. PATENT DOCUMENTS

| | | | | | |
|---|---|---|---|---|---|
| 705,578 | A | * | 7/1902 | Frderick | 221/279 |
| 1,057,158 | A | * | 3/1913 | Lynch et al. | 221/241 |
| 1,702,987 | A | * | 2/1929 | Wilson | 211/59.3 |
| 1,711,329 | A | * | 4/1929 | Short | 211/135 |
| 1,910,046 | A | * | 5/1933 | Pascoe | 211/59.3 |
| 2,079,754 | A | * | 5/1937 | Waxgiser | 211/59.3 |
| 2,098,844 | A | * | 11/1937 | Waxgiser | 211/59.3 |
| 2,506,369 | A | * | 5/1950 | Lever | 221/59 |
| 2,730,825 | A | * | 1/1956 | Wilds | 40/650 |
| 2,855,258 | A | * | 10/1958 | Moncier | 312/140.3 |
| 2,980,259 | A | * | 4/1961 | Fowlds | 211/59.3 |
| 3,348,732 | A | * | 10/1967 | Schwarz | 221/123 |
| 3,497,081 | A | * | 2/1970 | Field | 211/184 |
| 3,501,019 | A | * | 3/1970 | Armstrong et al. | 211/184 |
| 3,669,278 | A | * | 6/1972 | Heroy | 211/184 |
| 3,698,568 | A | * | 10/1972 | Armstrong | 211/184 |
| 3,954,184 | A | * | 5/1976 | Mendenhall | 211/184 |
| 4,119,208 | A | * | 10/1978 | Acker | 211/59.2 |
| 4,128,177 | A | * | 12/1978 | Bustos | 211/59.2 |
| 4,181,229 | A | * | 1/1980 | Moore | 211/184 |
| 4,618,063 | A | * | 10/1986 | Mendenhall | 211/184 |
| 4,762,236 | A | * | 8/1988 | Jackle et al. | 211/59.3 |
| 4,768,661 | A | * | 9/1988 | Pfeifer | 211/184 |
| 4,905,847 | A | * | 3/1990 | Hanson | 211/184 |
| 5,022,535 | A | * | 6/1991 | Spamer | 211/59.2 |
| 5,097,962 | A | * | 3/1992 | Eklof et al. | 211/59.2 |
| 5,148,927 | A | * | 9/1992 | Gebka | 211/184 |
| 5,160,051 | A | * | 11/1992 | Bustos | 211/59.2 |

(Continued)

*Primary Examiner* — Darnell Jayne
*Assistant Examiner* — Joshua Rodden
(74) *Attorney, Agent, or Firm* — Rosenthal Pauerstein Sandoloski Agather LLP; Alan R. Thiele

(57) ABSTRACT

The present invention relates generally to a shelf divider system for retail store product storage and display. More particularly, the present invention enables organization and presentation of a wide variety and types of products. A plurality of shelf dividers attach substantially perpendicularly to a pair of base strips. This perpendicular attachment is accomplished by inserting snap-fit pegs on the bottom of the shelf dividers into an array of mating holes formed in the base strips. Each adjacent pair of dividers forms a product organizing channel to keep the products in neat rows on the store shelf. Product paddles slide through the product organizing channel. An elongated pull ring attached to the product paddle causes products to move through the product organizing channel across the product shelf toward the front edge of the product shelf.

9 Claims, 12 Drawing Sheets

U.S. PATENT DOCUMENTS 5,190,186 A * 3/1993 Yablans et al. ..... 221/124
5,411,146 A * 5/1995 Jarecki et al. ..... 211/59.2
5,413,229 A * 5/1995 Zuberbuhler et al. ..... 211/59.3
5,450,968 A * 9/1995 Bustos ..... 211/59.2
5,464,105 A * 11/1995 Mandeltort ..... 211/184
5,469,976 A * 11/1995 Burchell ..... 211/59.3
5,555,990 A * 9/1996 Bechstein ..... 211/59.3
5,593,048 A * 1/1997 Johnson ..... 211/59.2
5,638,963 A * 6/1997 Finnelly et al. ..... 211/59.3
5,738,019 A * 4/1998 Parker ..... 108/108
6,082,557 A * 7/2000 Leahy ..... 211/59.3
6,142,317 A * 11/2000 Merl ..... 211/59.3
6,155,438 A * 12/2000 Close ..... 211/59.3
6,227,386 B1 * 5/2001 Close ..... 211/59.3
6,375,015 B1 * 4/2002 Wingate ..... 211/59.3
6,497,326 B1 * 12/2002 Osawa ..... 211/59.2
6,527,127 B2 * 3/2003 Dumontet ..... 211/59.3
6,533,131 B2 * 3/2003 Bada ..... 211/59.2
6,719,151 B2 * 4/2004 Close ..... 211/59.3
7,028,852 B2 * 4/2006 Johnson et al. ..... 211/59.3
7,216,770 B2 * 5/2007 Mueller et al. ..... 211/59.3
7,395,938 B2 * 7/2008 Merit et al. ..... 211/59.4
7,424,957 B1 * 9/2008 Luberto ..... 211/59.3
7,478,731 B1 * 1/2009 Mason ..... 211/59.3
7,641,057 B2 * 1/2010 Mueller et al. ..... 211/59.3
7,690,519 B2 * 4/2010 Kahl et al. ..... 211/59.2
7,784,623 B2 * 8/2010 Mueller et al. ..... 211/59.3
7,922,010 B2 * 4/2011 Hardy ..... 211/59.3
7,931,156 B2 * 4/2011 Hardy ..... 211/59.3
7,971,735 B2 * 7/2011 Mueller et al. ..... 211/59.3
2001/0002659 A1 * 6/2001 Bada ..... 211/59.2
2001/0013498 A1 * 8/2001 Sosso ..... 211/189
2002/0170866 A1 * 11/2002 Johnson et al. ..... 211/59.3
2003/0010737 A1 * 1/2003 Lee ..... 211/184
2003/0024889 A1 * 2/2003 Dumontet ..... 211/59.3
2003/0066811 A1 * 4/2003 Dimattio et al. ..... 211/59.2
2004/0178158 A1 * 9/2004 Close ..... 211/59.3
2004/0245197 A1 * 12/2004 McElvaney ..... 211/184
2005/0092703 A1 * 5/2005 Mueller et al. ..... 211/59.3
2005/0098515 A1 * 5/2005 Close ..... 211/59.3
2005/0150847 A1 * 7/2005 Hawkinson ..... 211/59.2
2005/0218094 A1 * 10/2005 Howerton et al. ..... 211/59.3
2005/0258113 A1 * 11/2005 Close et al. ..... 211/59.3
2005/0279722 A1 * 12/2005 Ali ..... 211/59.3
2006/0016774 A1 * 1/2006 Bustos ..... 211/186
2006/0186064 A1 * 8/2006 Merit et al. ..... 211/59.3
2006/0186066 A1 * 8/2006 Johnson et al. ..... 211/59.3
2006/0201897 A1 * 9/2006 Mueller et al. ..... 211/59.3
2007/0068885 A1 * 3/2007 Busto et al. ..... 211/59.3
2007/0138114 A1 * 6/2007 Dumontet ..... 211/59.3
2007/0194037 A1 * 8/2007 Close ..... 221/100
2007/0256992 A1 * 11/2007 Olson ..... 211/59.3
2007/0266911 A1 * 11/2007 Lee ..... 108/64
2007/0267366 A1 * 11/2007 Howerton et al. ..... 211/59.3
2008/0017598 A1 * 1/2008 Rataiczak et al. ..... 211/59.3
2008/0156752 A1 * 7/2008 Bryson et al. ..... 211/59.3
2009/0101606 A1 * 4/2009 Olson ..... 211/59.3
2010/0025346 A1 * 2/2010 Crawbuck et al. ..... 211/59.3
2010/0096345 A1 * 4/2010 Crawbuck et al. ..... 211/59.3

* cited by examiner

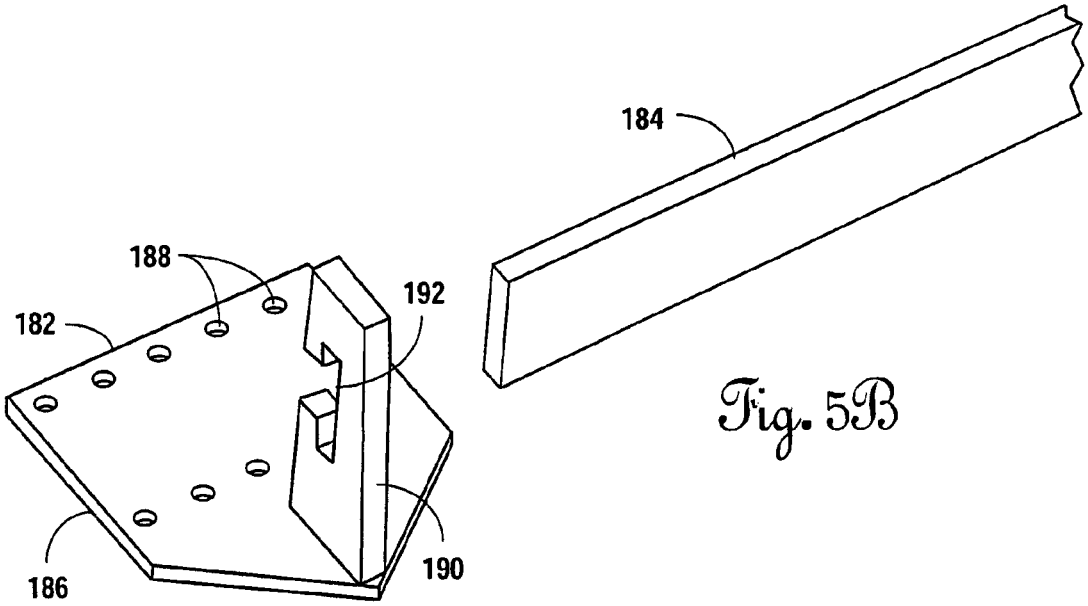
Fig. 5B
Fig. 5A
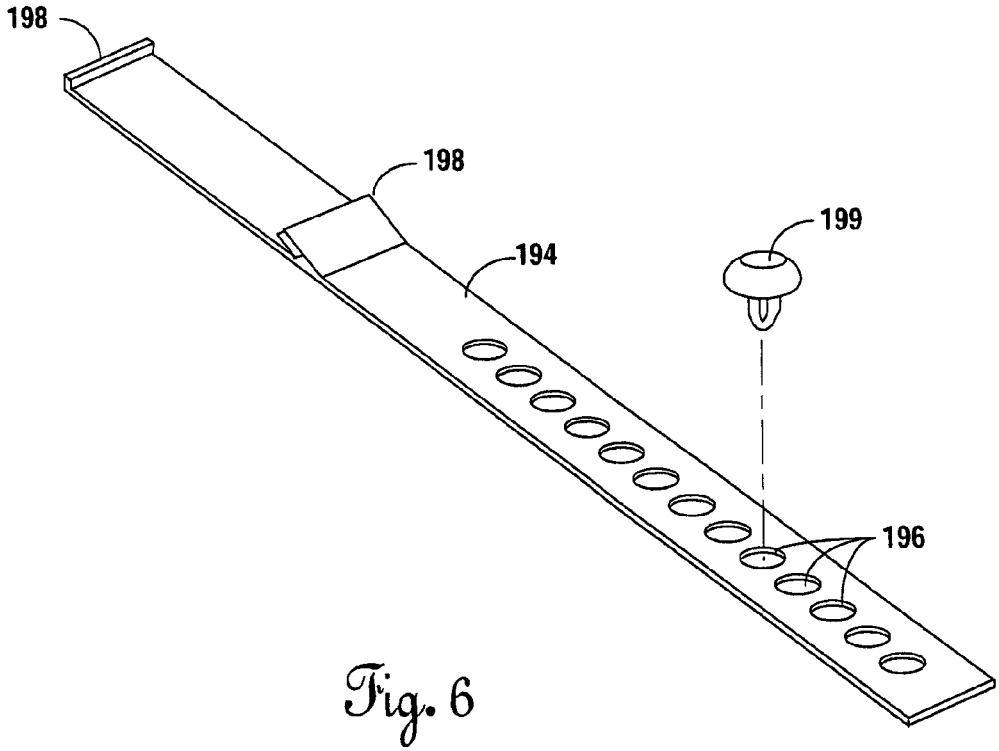
Fig. 6

PRODUCT SHELF DIVIDER SYSTEM AND METHOD

CROSS REFERENCE TO RELATED APPLICATIONS

This application is a continuation-in-part of U.S. patent application Ser. No. 11/381,587 filed May 4, 2006, now abandoned. This application also claims the benefit of Provisional U.S. Patent Application No. 61/190,267 filed Aug. 27, 2008.

STATEMENT REGARDING FEDERALLY FUNDED RESEARCH AND DEVELOPMENT

The invention described in this patent application was not the subject of federally funded research or development.

FIELD

The present invention relates generally to a shelf divider system for product storage and display; more particularly, the present invention enables organization of a wide variety and types of products, e.g. spices, baby food, wine, canned goods, boxed items, gallon sized containers, etc., as well as any size frozen product positionable on product shelves, such as those product shelves typically found in a retail store or in the warehouse of a product distributor.

BACKGROUND

In retail stores or in product distribution warehouses, freestanding products are often stocked and displayed on a plurality of open product shelves. These open product shelves are positioned by being mounted within a rack. Product shelf stockers must manually arrange, organize, and straighten rows of product on each product shelf in the shelf-mounting rack to cause the product to be readily displayed to the user. Known as "facing, fronting, or zoning," this organizing process normally occurs during off-peak times and typically requires hours of manual sorting, organization, and placement of individual product on product shelves.

Freestanding products on open product shelves are unsightly and also present a problem for shoppers and product shelf stockers. This problem occurs when different types or brands of products become disorganized prior to facing by being pushed to the back portion of the product shelf. When the items on the front of the product shelf are removed from the product shelf by other shoppers or shelf stockers, the remaining items positioned towards the back portion of the product shelf are not easily viewable, nor accessible, by store shoppers and product shelf stockers. This lack of visibility and accessibility often results in both lost product and lost sales for the business.

Still other issues arise with moving and facing freestanding product items having different shapes and weights. Heavier items, such as a gallon wine jug or some cleaning products, may be too heavy for a shopper and product shelf stocker to move to the front of the product shelf. Smaller, lighter products, such as baby food and spice jars, or products with a high center of gravity, may also be difficult to slide forward from the back of the product shelf without causing unselected product to topple over. Softer products, such as bread, potato chips, and bags of cut salad greens, can easily be damaged during the facing process by product shelf stockers and by shoppers during the shopping process.

A number of prior art product shelf divider systems attempt to solve the problems associated with freestanding products positioned on product shelves. Some prior art product shelf divider systems use clear plastic dividers to separate different types of products; however, these prior art shelf divider systems have no mechanism for moving products on the rear of the product shelf to the front of the product shelf. Thus, products stacked towards the rear portion of the product shelf remain unseen by shoppers and product shelf stockers.

Yet other prior art product shelf divider systems include coil springs. The coil springs are sized and positioned to push products forward across the product shelf as the product nearest the front edge of the product shelf is removed. It has been found that many prior art coil springs fail when a product is too heavy to be pushed forward across a product shelf. Other systems disclosed in the prior art include the use of magnetic attraction and/or ribbon springs to move products forward to the front edge of the product shelf.

The prior art product shelf divider systems described above present significant drawbacks resulting in limited commercial use and user frustration. Accordingly, a need remains in the art for a product shelf divider system that will effectively separate, organize, and display products on a product shelf as well as easily move products from the back edge of the product shelf across the product shelf to the front edge of the product shelf. It is also important that the product shelf divider system conserve product shelf space by minimizing wasted shelf space between rows of products. Further, the needed product shelf divider system should facilitate quick assembly, easy installation, and rapid removal from a product shelf without the need for multiple tools and fasteners.

SUMMARY

The disclosed product shelf divider system organizes, moves, and displays products on product display shelves. Further, the disclosed product shelf divider system facilitates quick assembly, easy installation, and rapid removal from a product shelf without the need for multiple tools and fasteners.

According to the disclosed invention, a plurality of product shelf dividers are adjustably mounted in a substantially perpendicular manner to a first and a second base strip. The first base strip is positioned near the front edge of the product shelf and the second base strip is positioned near the back edge of the product shelf. In a first embodiment, the first and second base strips are attached to the product shelf with clips. The substantially perpendicular attachment of the product shelf dividers to each product shelf is accomplished by inserting snap-fit pegs formed on the bottom of each shelf divider into an array of mating holes formed in each base strip. Each pair of product shelf dividers forms a product organizing channel across the product shelf. Each product organizing channel is tailored to the size of the product when a pair of product shelf dividers is adjustably positioned with respect to the base strips. The product organizing channel keeps the products in neat rows on the product shelf. Product paddles slide through the product organizing channel between each adjacent pair of shelf dividers. Attached to the product paddle is a pull strap that allows a shopper and/or product shelf stocker to pull products through the product organizing channel towards the front of the product shelf.

In a second embodiment, a spring biased elongated pull ring is attached to each product paddle. The spring biased elongated pull ring allows shoppers and product shelf stockers to cause products to move forward toward the front edge of the product display shelf within the product organizing channel. A first and a second product guard are positioned in a substantially perpendicular manner to the first and second base strips to prevent the products positioned near the edges of the product shelf from falling off the product shelf.

The second embodiment of the disclosed shelf divider system further includes a carrier system which retracts the elongated pull ring using a retractable cord reel assembly attached by a spring clip to the elongated pull ring.

BRIEF DESCRIPTION OF THE DRAWING FIGURES

A still better understanding of the product shelf divider system and method for organizing products on product shelves may be had by reference to the following Description of the Embodiments when read together with the following drawing figures wherein:

FIG. 5A is a perspective view of a product guard holder;

FIG. 5B is a perspective view of a product guard;

FIG. 6 is a perspective view of a clip which attaches the first embodiment of the product shelf divider system to the product shelf;

DESCRIPTION OF THE EMBODIMENTS

Figure 1:
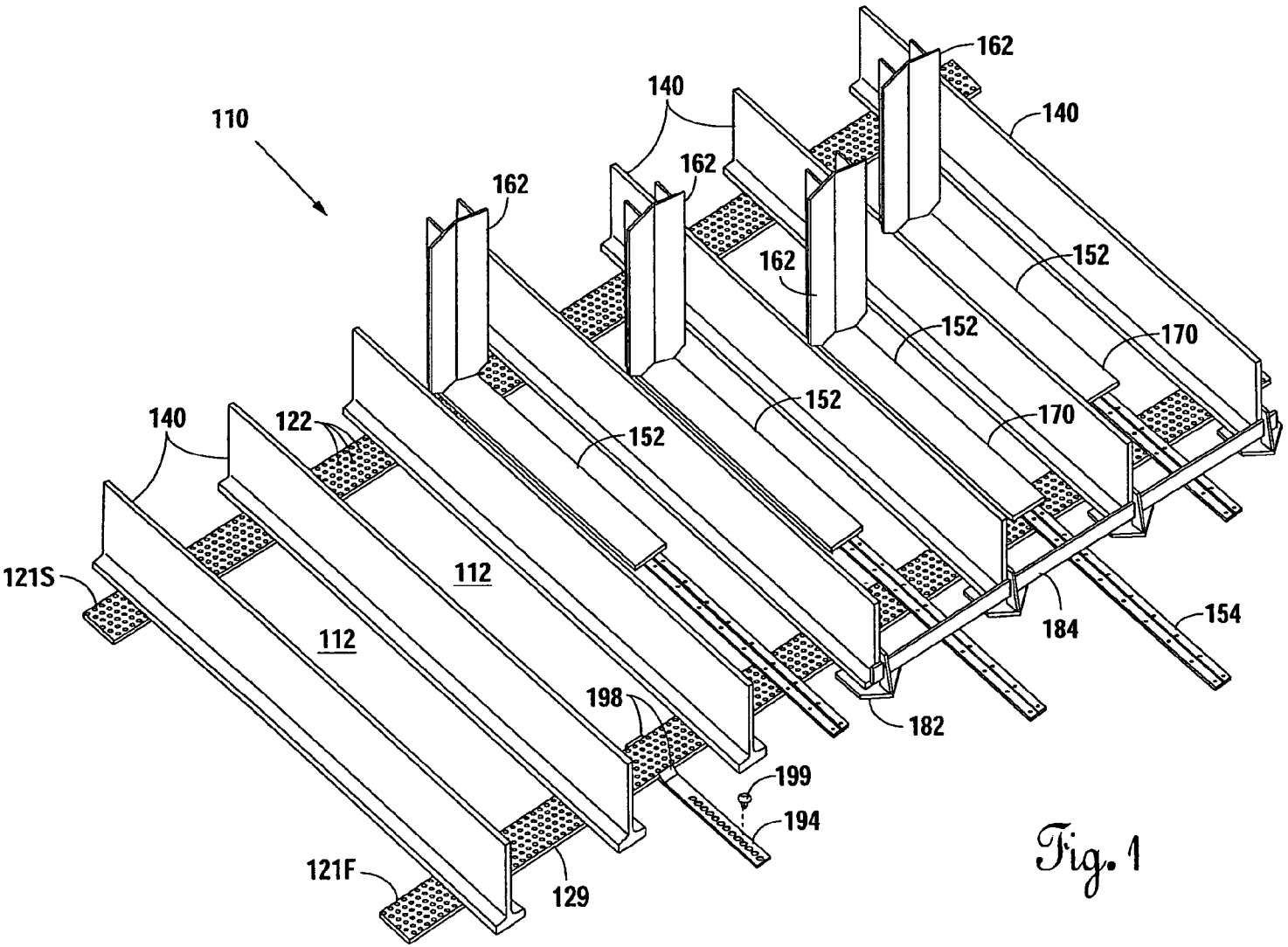
FIG. 1 is a perspective view of the first embodiment of the disclosed shelf divider system.

FIG. 1 is a perspective view of the first embodiment of the shelf divider system 110 of the present invention. The shelf divider system 110 includes a first base strip 121F and second base strip 121S. It is the first and second base strips 121F, 121S which are attached to the product shelves by clips 194 and which form the foundation on which the product display system of the present invention is constructed. In the preferred embodiment, both first and second base strips 121F, 121S have beveled edges 129. The base strips 121F, 121S include a plurality of spaced mating holes 122. The spaced mating holes 122 are key to the utility of the present invention as they provide for creating a product organizing channel 112 on the product shelf tailored to the width of the product.

Figure 2A:
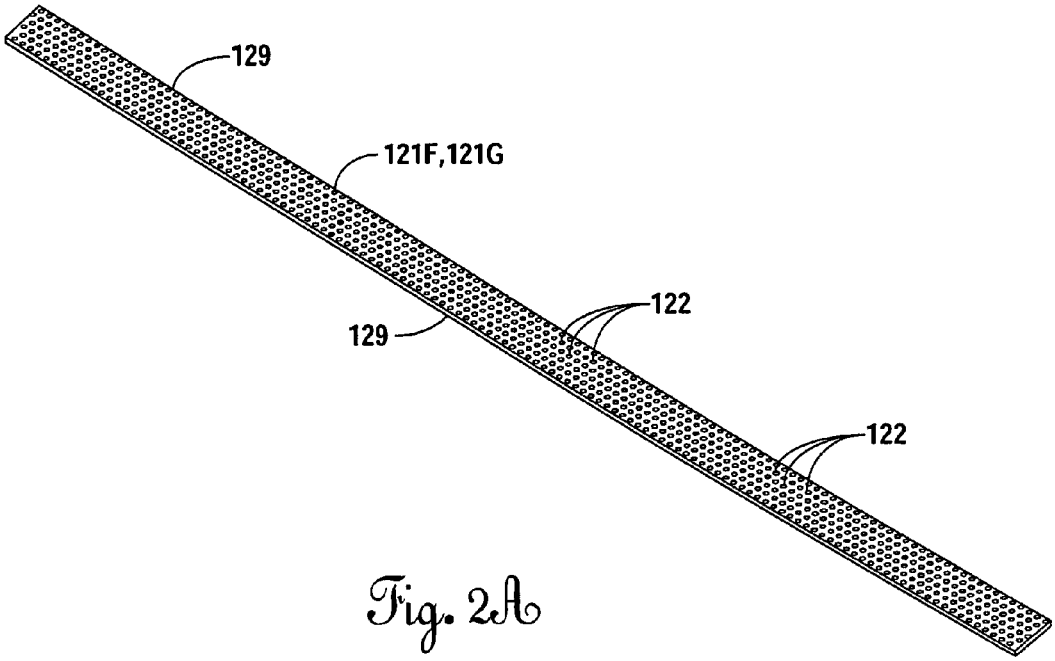
FIG. 2A is a perspective view of a base strip of the shelf divider system shown in FIG. 1.
Figure 2B:
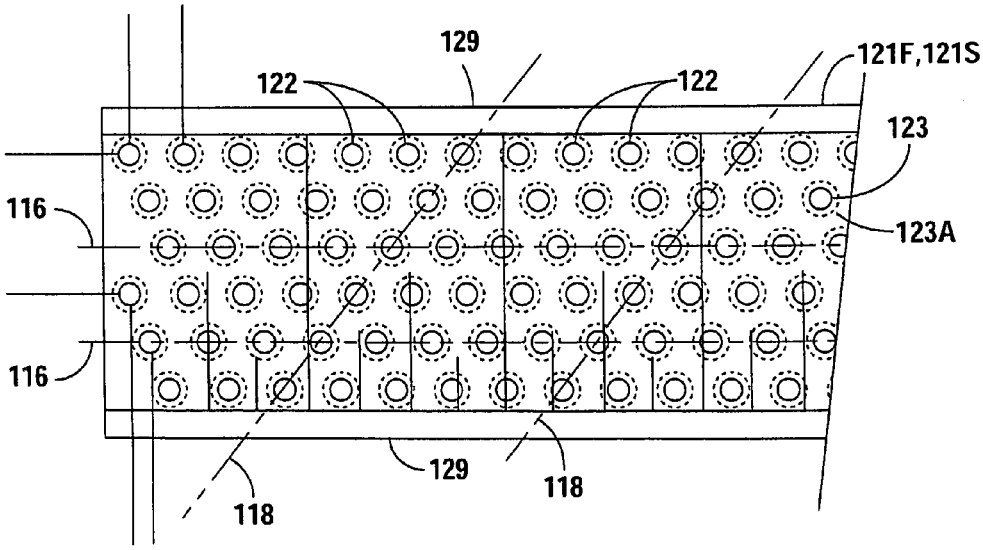
FIG. 2B is a top plan view of a portion of the base strip shown in FIG. 2A.

As shown in FIGS. 1, 2A and 2B the plurality of spaced mating holes 122 in the base strips 121F, 121S are arranged in six rows. The first base strip 121F is positioned near the front edge of the product shelf and the second base strip 121S is positioned near the back edge of the product shelf. To understand the positioning of the mating holes 122, each base strip 121F, 121S has a plurality of longitudinal axes 116 running substantially parallel to the edges of each base strip 121F, 121S, as shown in FIG. 2B. Further shown in FIG. 2B, each base strip 121F, 121S has a plurality of transverse axes 118 positioned at an acute angle of about 45 degrees to about 65 degrees to said longitudinal axis 116. The mating holes 122 are positioned on the intersections of the longitudinal axes 116 and transverse axes 118, as shown in FIG. 2B. In the preferred embodiment, the plurality of mating holes 122 in the base strips 121F, 121S are stepped; that is, the holes 122 have two diameters, as shown by dashed lines encircling the mating holes 122 in the base strip 121F, 121S in FIG. 2B. The larger diameter portion of each mating hole 122 provides a target for the snap-fit pegs 146 and guidance for the interference fit with the snap-fit pegs 146 provided by the smaller diameter. In the preferred embodiment, the top of each snap-fit peg 146 is either co-planar with or just below the surface 123A of the base strips 121F, 121S. The top of the snap-fit pegs 146 may also be shaped so as to protrude from the recessed portion 123 of the surface 123A of the base strip 121F, 121S, when pushed through mating holes 122.

Figure 3A:
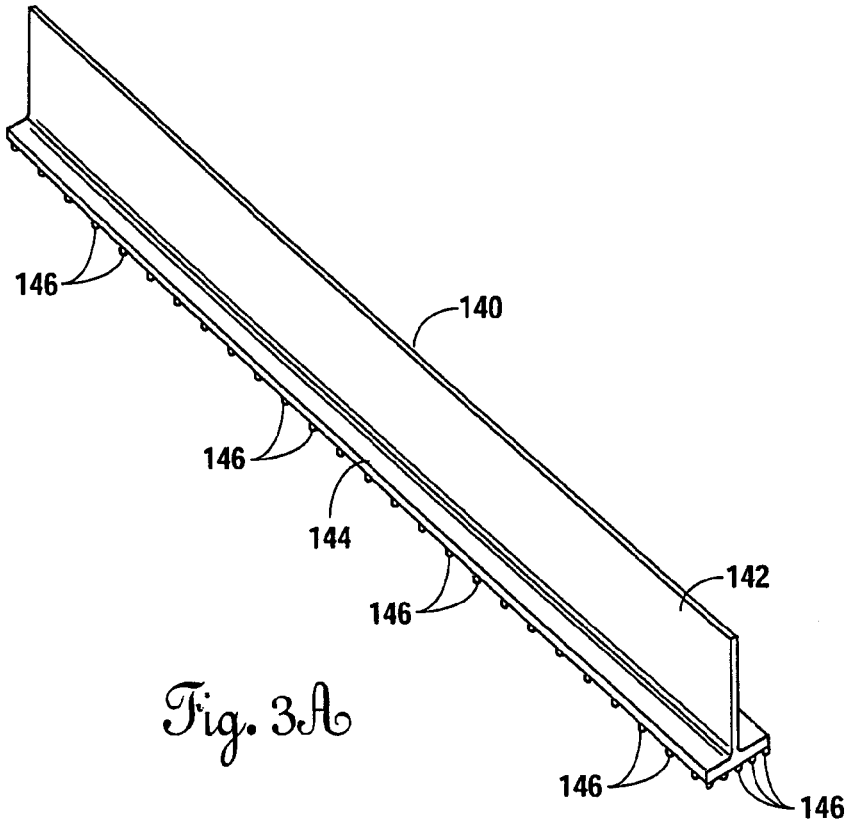
FIG. 3A is a perspective view of a product shelf divider.

The product shelf divider system 110 further includes a plurality of product shelf dividers 140, as shown in FIGS. 1 and 3A. The product shelf dividers 140 are mounted substantially perpendicular to the base strips 121F, 121S. Once mounted to the base strips 121F, 121S by the interfitment of the snap-fit pegs 146, shown in FIG. 3B, on the bottom of each product shelf divider 140 into the mating holes 122 in each base strip 121F, 121S, each adjacent pair of shelf dividers 140 forms a product organizing channel 112.

Figure 4A:
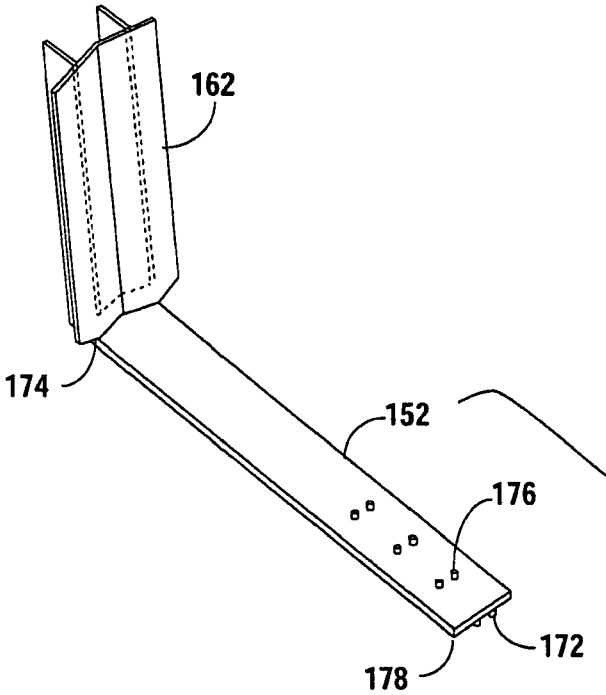
FIG. 4A is a perspective view of the product paddle.
Figure 4B:
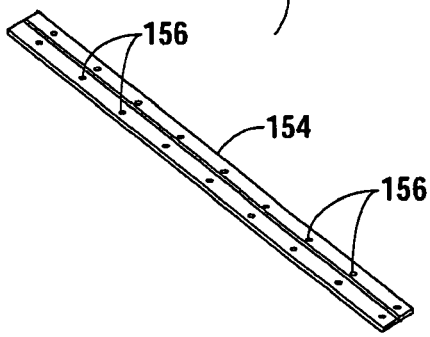
FIG. 4B is a perspective view of the elongated pull strap.

Within each product organizing channel 112 is a product paddle 152. As shown in FIGS. 1 and 4A, the product paddle 152 is positioned to move between each adjacent pair of shelf dividers 140. Each product paddle 152 is attached to an elongated runner 170. The elongated runner 170 is attached at its distal end 174 to a product paddle backstop 162. Attached to the proximal end 172 of the product paddle 152 is a pull strap 154, as shown in FIG. 4B. The proximal end 172 of the elongated runner 170 slidably moves over at least one base strip 121F, as described below. Shown in FIG. 4A, the elongated runner 170 has beveled edges 178 in the preferred embodiment for a smoother sliding engagement over the first base strip 121F.

The elongated runner 170 has a plurality of spaced snap-fit knobs 176 near the proximal end 172 of the elongated runner 170 as shown in FIG. 4A. In turn, the pull straps 154 have a plurality of spaced holes 156 designed to mate with the spaced snap-fit knobs 176 on the elongated runner 170. When the spaced snap-fit knobs 176 mate with spaced holes 156 on the pull straps 154, the pull strap 154 is attached to the elongated runner 170, but may be spaced as required. The pull strap 154 allows shoppers and product shelf stockers to pull the product paddle 152 forward, thus causing the products to move through the product organizing channel 112 formed between the spaced shelf dividers 140 to the front edge of the product shelf as described below.

Each shelf divider 140 has an elongated base portion 144 and an upstanding wall portion 142. As shown in FIG. 3A the upstanding wall portion 142 extends upwardly from the base 144 of the shelf divider 140. The cross-sectional shape of the shelf divider 140 may be described as an inverted, or upside-down, "T." In FIG. 3B, a plurality of snap-fit pegs 146 are shown extending downwardly from the elongated base portion 144 of the product shelf divider 140. The snap-fit pegs 146 are arranged in rows and columns, for interfitment with the plurality of spaced holes 122 on the base strips 121F, 121S as described above. Through placement of the snap-fit pegs 146 and the mating holes 122, it has been found that the size of the product organizing channel 112 may be adjusted in increments as small as about 1/16 inch. Accordingly, the arrangement of the snap-fit pegs 146 and the mating holes 122 allows attachment of the shelf dividers 140 to the base strips 121F, 121S as closely as possible to the products to prevent wasted shelf space. Upon interfitment of the snap-fit pegs 146 in the mating holes 122, the shelf dividers 140 are substantially perpendicularly mounted to the base strips 121F, 121S.

The shelf dividers 140 are sized for attachment to the first and second base strips 121F, 121S by an interference fit of the snap-fit pegs 146 within the plurality of mating holes 122 in the base strips 121F, 121S. The snap-fit pegs 146 include an expanded portion on top to allow snap interfitment within the plurality of mating holes 122 in the base strips 121F, 121S. The snap-fit pegs 146, to include their expanded portions may be constructed in a variety of different shapes to interfit within a plurality of differently shaped holes 122 in the base strips 121F, 121S.

A product guard holder 182 is attached to the front ends of the shelf dividers 140, as shown in FIG. 1. An elongated product guard 184 attaches to the product guard holders 182 to prevent the stored products from falling off the front edge of the product shelf. A transparent product guard 184 enables easy viewing of product remaining on the product shelf.

Figure 3B:
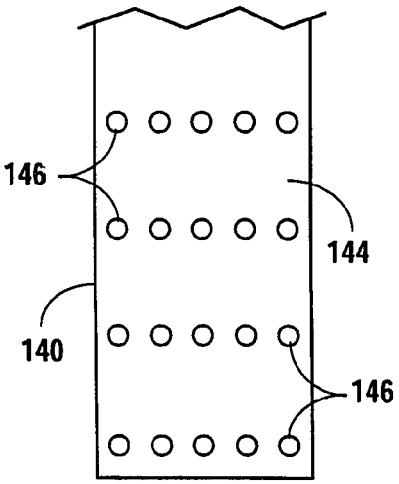
FIG. 3B is an underside or bottom plan view of a portion of the product shelf divider.

Shown in more detail in FIG. 5A, each product guard holder 182 includes a base portion 186 with a plurality of spaced holes 188 formed therein. A product guard receptor 190 extends substantially perpendicularly from the base 186 of the product guard holder 182. The product guard receptor 190 includes an opening 192 for receiving the elongated product guard 184. The snap-fit pegs 146, as shown in FIGS. 3A and 3B, located on the underside of the shelf dividers 140, mate with the plurality of spaced holes 188 on the base 186 of product guard holders 182 to attach the product guard holders 182 to the shelf dividers 140.

A clip 194, as shown in FIGS. 1 and 6, is used to connect the shelf divider system 110 to the store shelf. On one end of the clip 194 are a pair of spaced tabs 198. The spaced tabs 198 attach the clip 194 to the first base strip 121F. On the opposite end of the clip 194 are a plurality of spaced holes 196. The spaced holes 196 extend inwardly for receiving a push-in fastener 199. The push-in fastener 199 connects the clip 194 and the attached first base strip 121F to the product shelf. By use of the clip 194, the shelf divider system 110 is properly secured to the product shelf and will not move when products are caused to move across the surface of the product shelf through the product organizing channel 112.

Figure 7:
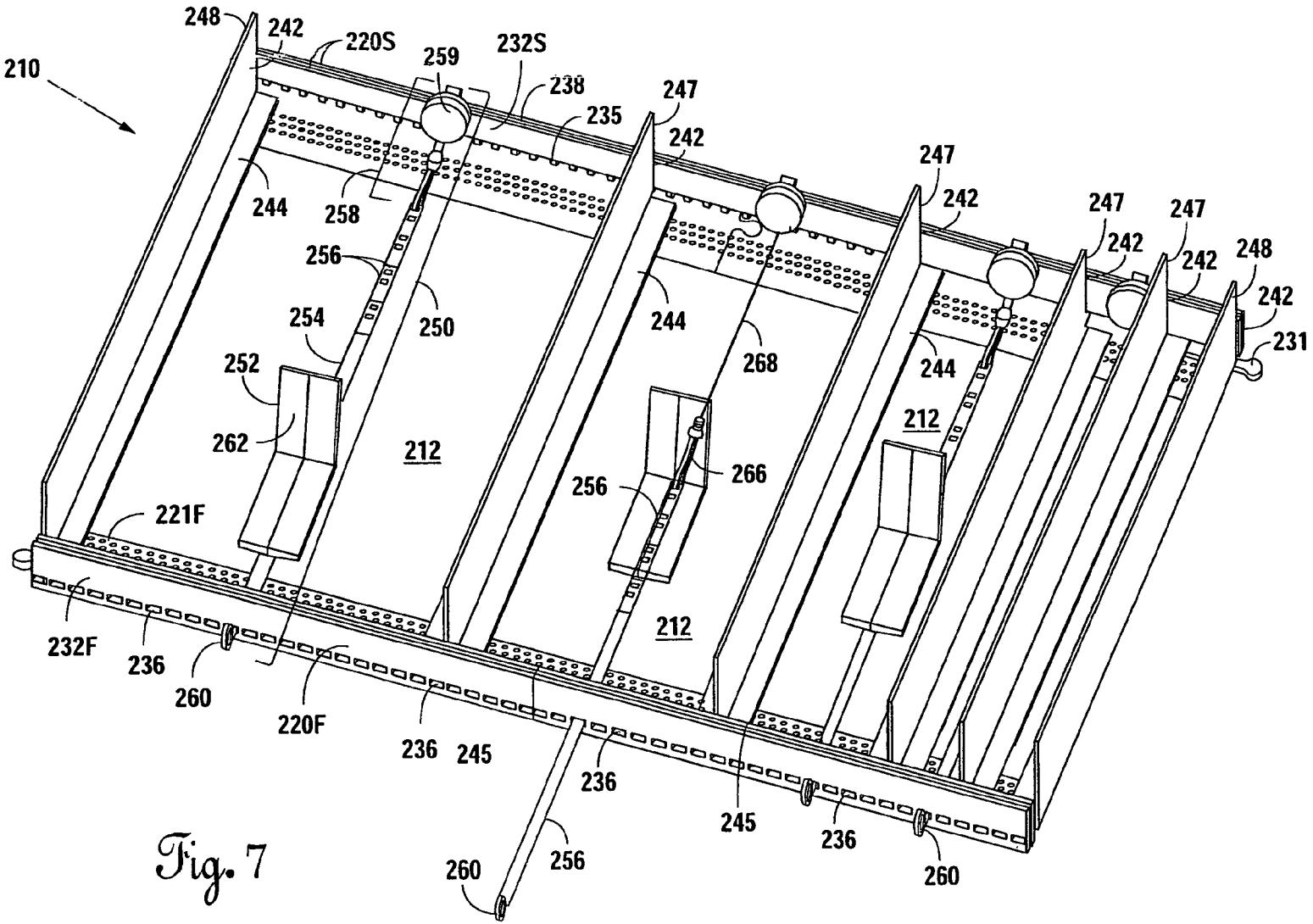
FIG. 7 is a perspective view of the second embodiment of the disclosed product shelf divider system.
Figure 9A:
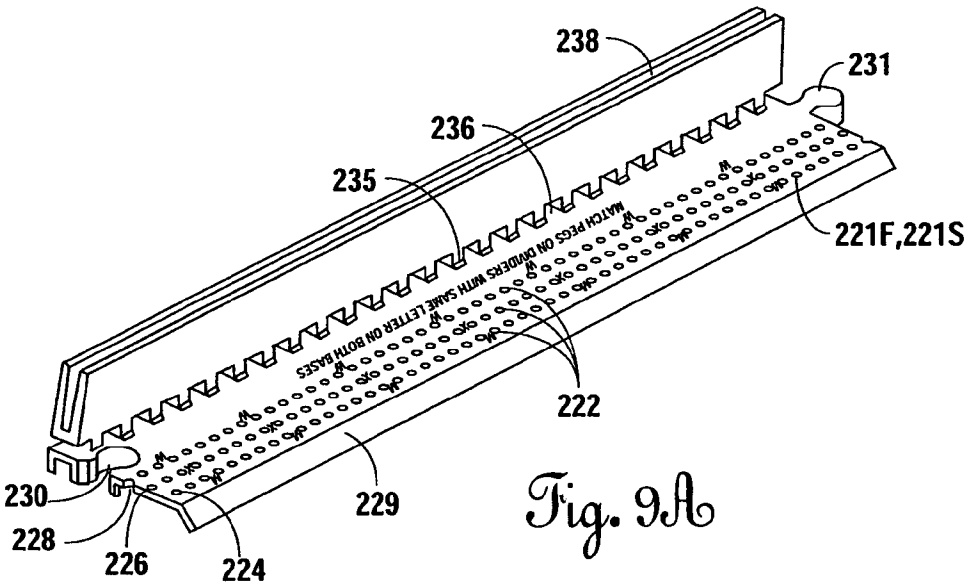
FIG. 9A is a perspective view of the base strip and product guard assembly as shown in FIG. 7.
Figure 9B:
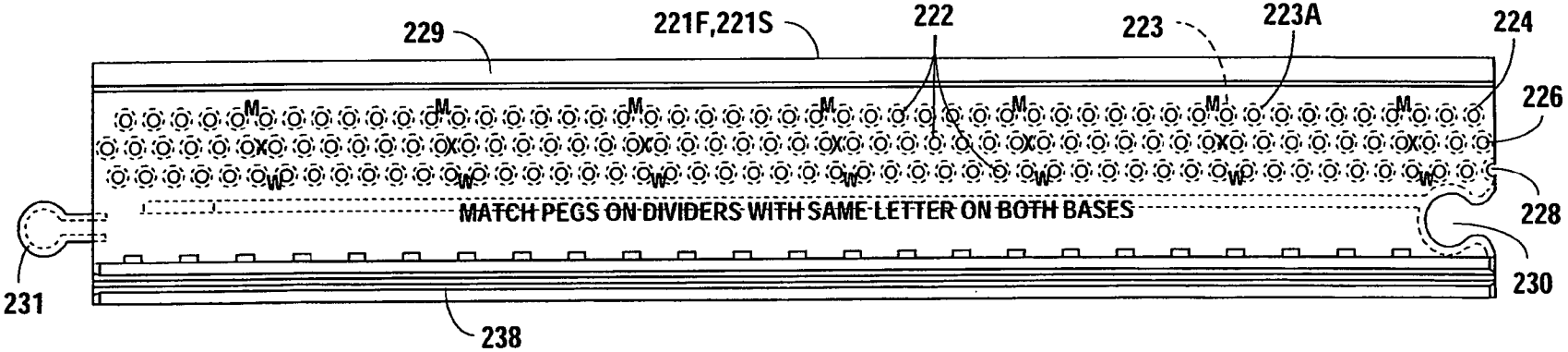
FIG. 9B is a top plan view of the base strip portion of the base strip and product guard assembly shown in FIG. 9A.

In the second embodiment 210 of the disclosed invention and as shown in FIG. 7, the base strip and product guard are formed together as an assembly 220F, 220S. A first base strip 221F is placed near the front edge of the product display shelf and a second base strip 221S is placed near the rear edge of the product shelf. A first base strip and product guard assembly 220F is positioned substantially parallel to the front edge of the product shelf. A second base strip and product guard assembly 220S is positioned substantially parallel to the rear edge of the product shelf. The first and second base strip and product guard assemblies 220F, 220S include first and second base strips 221F, 221S and first and second product guards 232F, 232S which extend substantially perpendicularly from the first and second base strips 232F, 232S respectively. The first and second base strips 221F, 221S are mirror images of each other and include beveled edges 229. As shown in FIGS. 9A and 9B, the first and second base strip and product guard assemblies 220F, 220S are preferably made into twelve inch long segments with interlocking members 230, 231 formed at each end. The interlocking receiving slot 230 on the end of each base strip 221F, 221S is sized to receive the interlocking extension tab 231 on the end of the adjacent base strip 221F, 221S. The interlocking members 230, 231 on each base strip 221F, 221S connect to form a continuous length of base strips 221F, 221S along both the front edge and the back edge of each product shelf.

In the second embodiment 210, the first and second base strips 221F, 221S include only three rows of a plurality of spaced mating holes 222 to provide incremental spacing for attachment of shelf dividers 247, 248, as shown in FIG. 7. The plurality of spaced holes mating 222 in the first and second base strips 221F, 221S are arranged and staggered in at least three parallel, sequential rows, as shown in FIGS. 7, 9A, 9B, 9C, and 9D. While three parallel, sequential rows are shown in the illustrated embodiment 210, those of ordinary skill in the art will understand that any number of rows may be used without detracting from the operability of the disclosed invention. As in the first embodiment, the plurality of spaced mating holes 222 in the base strips 221F, 221S are formed into rows substantially parallel to the longitudinal axes 206 of each base strip 221F, 221S and into columns formed along transverse axes 208 of each base strip 221F, 221S. The transverse axes 218 are formed at a substantially acute angle between about 45° to about 65° to the longitudinal axis 206 of the first and second base strips 221F, 221S.

A pair of individual upside-down "T" shaped shelf dividers 247 having snap-fit pegs 246 located on the bottom surface of the elongated base portion 244 of the shelf dividers 247, 248, enable a substantially perpendicular mounting of the shelf dividers 247, 248 to the base strips 221F, 221S, as shown in FIG. 7. A shelf divider only half of the upside-down "T" shaped divider 247 is used. A substantially "L" shaped shelf divider 248 is used in place of the substantially upside-down "T" shaped divider 247 at the end of a product shelf to designate the outer edge of the shelf divider system 210.

Figure 10A:
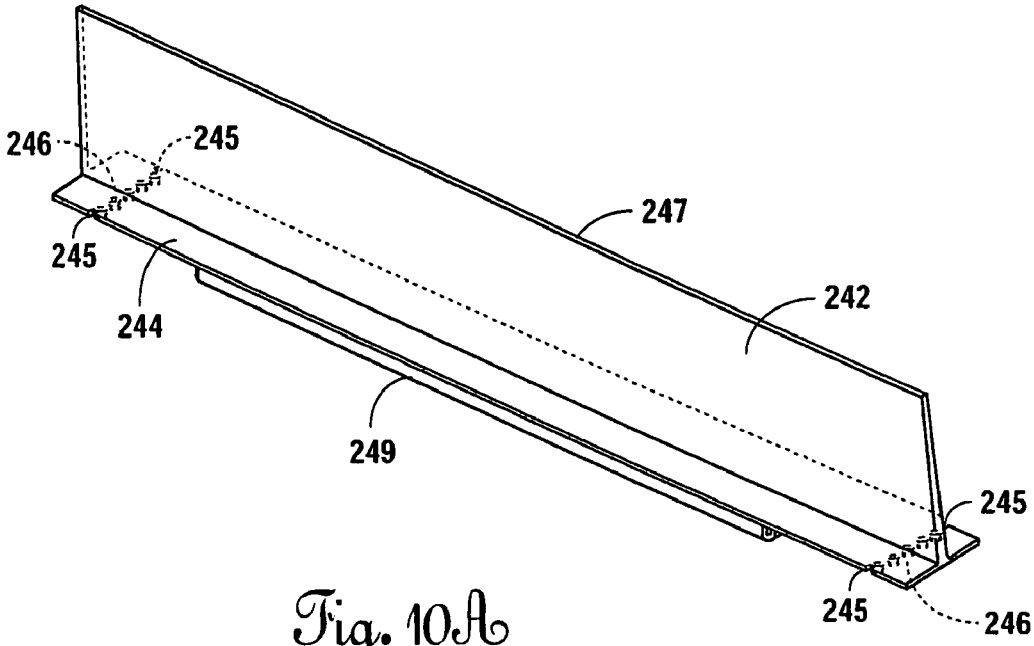
FIG. 10A is a perspective view of the shelf divider.
Figure 10B:
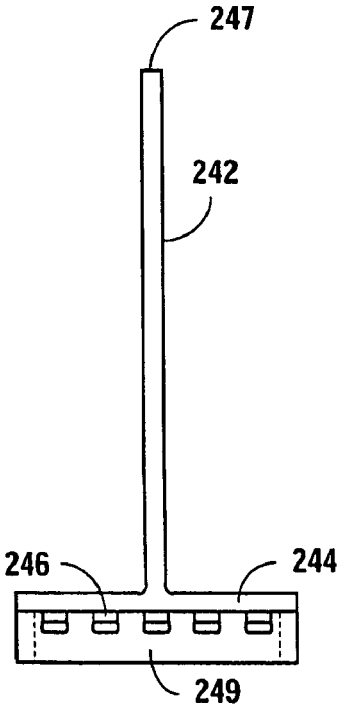
FIG. 10B is a side elevational view of the shelf divider.

Each shelf divider 247, shown in FIGS. 7, 10A, and 10B, is flat piece with a thin perpendicular divider shaped as a substantially upside-down "T" 247. The elongated base portion 244 of the substantially upside-down "T" 247, attaches in a substantially perpendicular manner to each base strip 221F, 221S when snap-fit pegs 246 interfit with the plurality of spaced mating holes 222 on the base strips 221F, 221S. The use of a mating array of snap-fit pegs 246 with the plurality of spaced mating holes 222 enables customization of the width of each product organizing channel 212 between the shelf dividers 247, 248. Such customization is very important to provide multiple spacings of various widths to accommodate the many different sizes of the product that will be able to move between the shelf dividers 247, 248.

As shown in FIG. 10A, each end of the shelf divider 247, 248 includes a plurality of snap-fit pegs 246 on the bottom of the elongated base portion 244 of the shelf divider 247, 248. The snap-fit pegs 246 illustrated in the second embodiment are formed in a substantially perpendicular manner to the shelf divider 247, 248. Those of ordinary skill in the art will understand that different numbers of snap-fit pegs 246 may be used. Notches 245 formed on the edges of each shelf divider 247, 248 show the user where the snap-fit pegs 246 are located on the underside of the elongated base portion 244 of the shelf divider 247, 248 for easier alignment with the plurality of mating holes 222 in the base strips 221F, 221S.

Figure 10C:
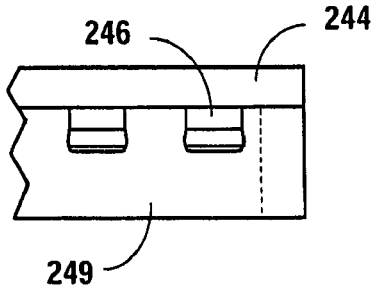
FIG. 10C is an enlarged side elevational view showing the snap-fit pegs and a reinforcement on the bottom of the shelf divider.
Figure 10D:
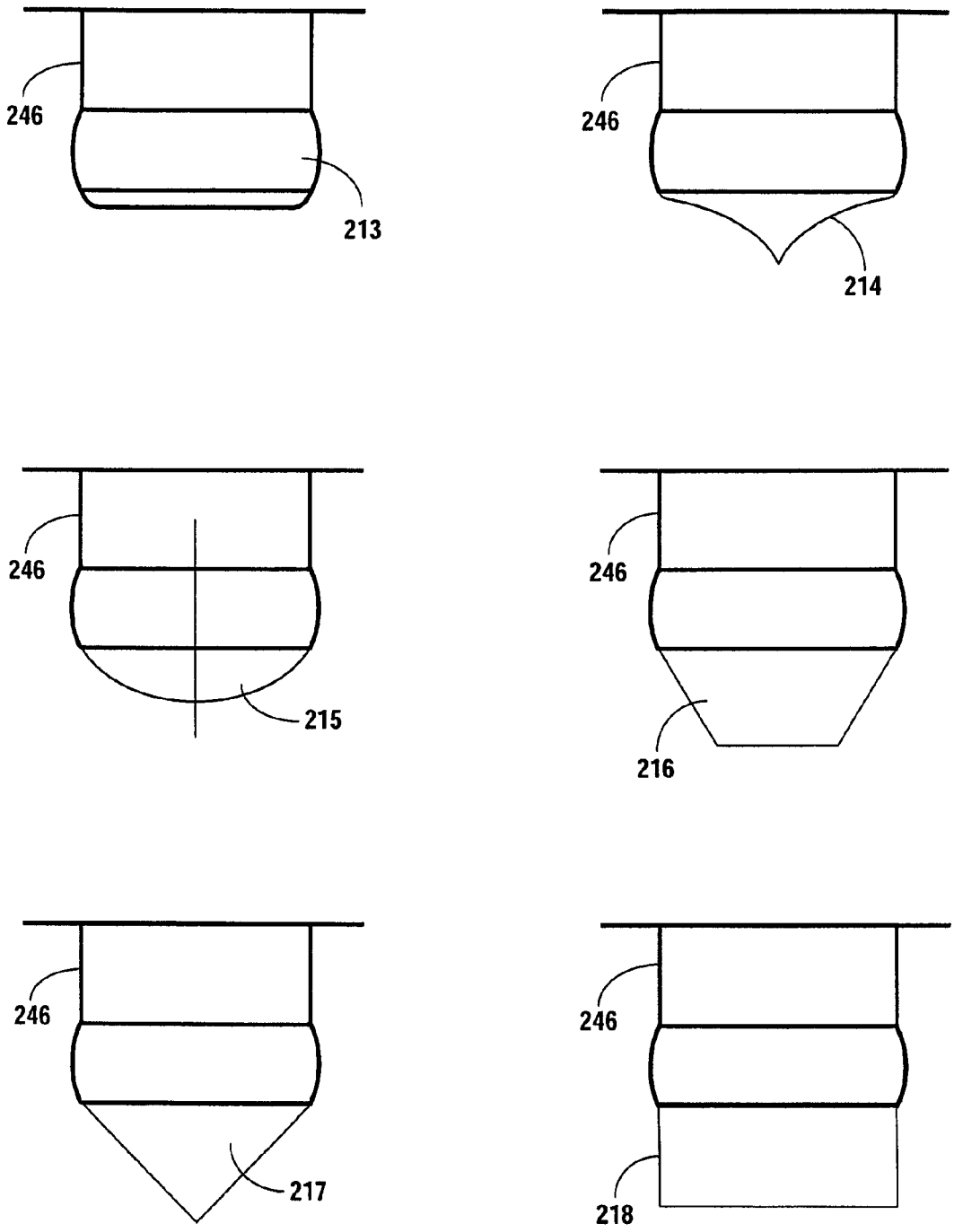
FIG. 10D is a side elevational view of a variety of different snap-fit peg profiles.
Figure 11A:
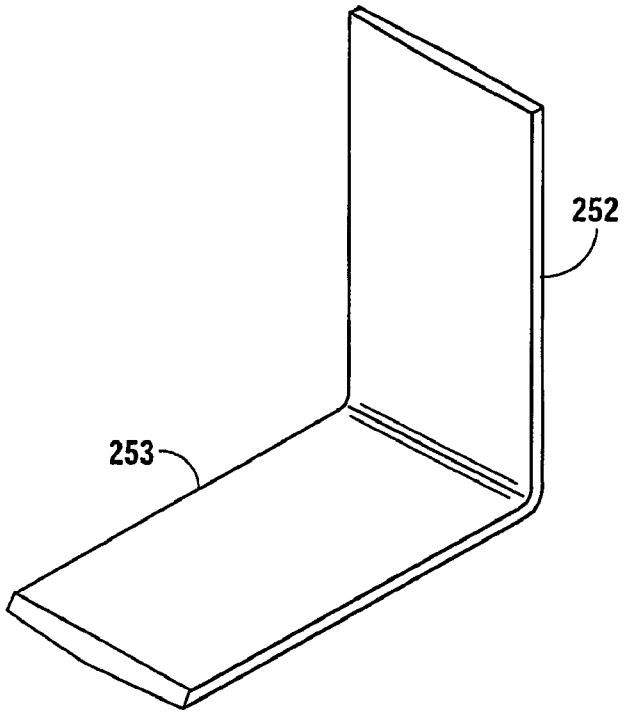
FIG. 11A is a perspective view of the product paddle.
Figure 11B:
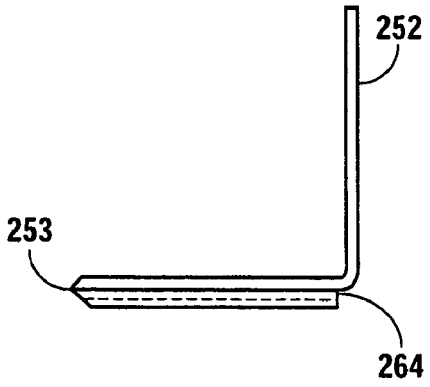
FIG. 11B is a side elevational view of the product paddle.

In the preferred embodiment, the shelf dividers 247, 248 are sized for attachment to the first and second base strips 221F, 221S by an interference fit of the snap-fit pegs 246 within the plurality of mating holes 222 in the base strips 221F, 221S. As shown in FIGS. 10B and 10C, the snap-fit pegs 246 include an expanded portion on top to allow snap interfitment within the plurality of mating holes 222 in the base strips 221F, 221S. As shown in FIG. 10D, the snap-fit pegs 246 and its expanded portion may be constructed in a variety of different shapes to interfit within a plurality of differently shaped mating holes 222 in the base strips 221F, 221S. The variety of shapes for the pegs 246 expanded portion may include, but are not limited to: mushroom-shaped 213, cardioid cusp-shaped 214, rounded 215, tapered 216, triangular 217, and squared 218. While substantially circular pegs are shown in the illustrated embodiment 210, those of ordinary skill in the art will understand that flat-sided pegs may be used without detracting from the operability of the disclosed invention.

Figure 9C:
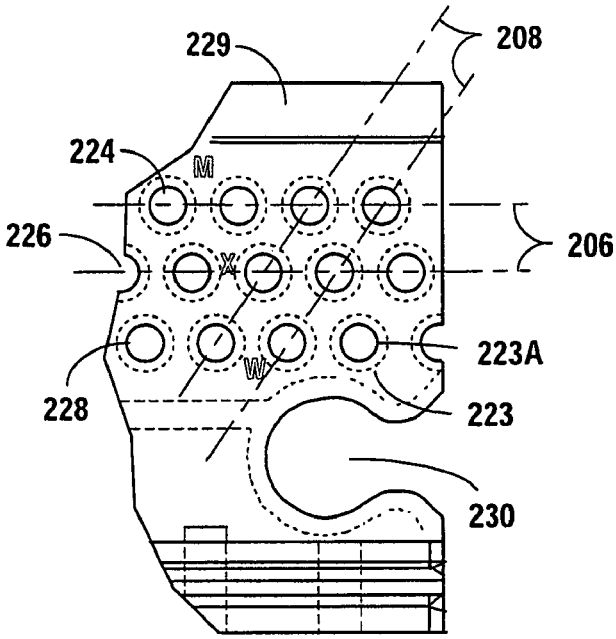
FIG. 9C is top plan view of an interlocking receiving slot on the base strip.
Figure 9D:
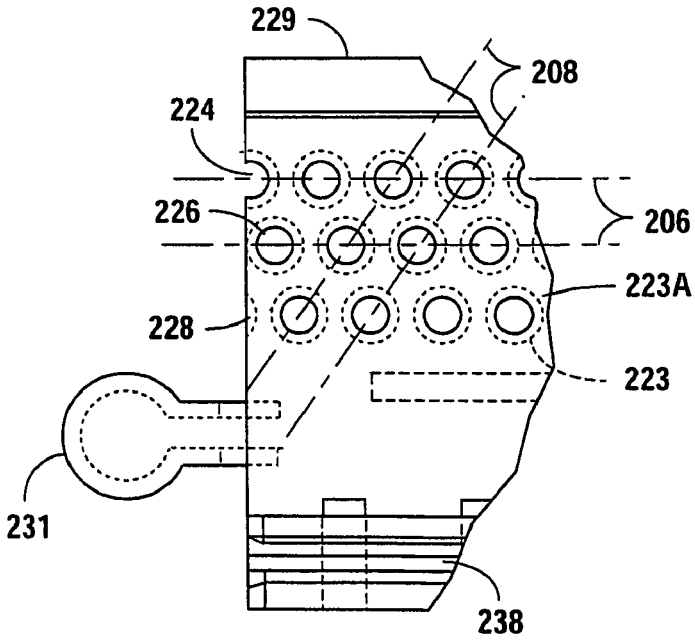
FIG. 9D is a top plan view of an interlocking extension tab end on the base strip.

As described with respect to the first embodiment, the plurality of mating holes 222 are stepped; that is, they have a large diameter portion and a reduced diameter portion. The reduced diameter portion enables the interference fit with the snap-fit pegs 246. The two diameters are shown by dashed lines encircling the mating holes 222 in the base strip 221F, 221S, as shown in FIGS. 9B, 9C, and 9D. In the preferred embodiment, the top of each snap-fit peg 246 is either coplanar with or just below the surface 223A of the base strips 221F, 221S. The top of the snap-fit pegs 246 may also be shaped so as to protrude from the recessed portion 223 of the surface 223A of the base strip 221F, 221S, when pushed through mating holes 222.

The snap fit feature of the pegs 246 facilitates assembly by providing the user with a sound or feel that the shelf divider 247, 248 is properly attached to the base strips 221F, 221S. Snap-fitting the pegs 246 also provides a break-away feature should the shelf divider 247, 248 be pushed or jolted out of place by a shopper or product shelf stocker while products are stacked within the product organizing channel 212. The snap-fit pegs 246 allow the shelf divider 247, 248 to dislodge itself from the base strips 221F, 221S if jolted out of place and then serve as a cushion for any products which may fall over. The snap-fit feature of the pegs 246 also prevents the pegs 246 from shearing off the bottom of the shelf divider 247, 248 should the shelf divider 247, 248 be jolted out of place. Sizing the pegs 246 to form an interference fit with the plurality of mating holes 222 in the base strips 221F, 221S, while preventing the pegs from shearing off the bottom of the shelf divider if knocked out of place, creates a reusable system for a product shelf.

The base strip and product guard assemblies 220F, 220S have unique assembly instructions. The spacing required between the first and second base strips 221F, 221S that allows the disclosed shelf divider system 210 to function properly is critical. As shown in FIGS. 9C and 9D, this critical distance must be from the middle row 226 of offset mating holes 222 on the first base strip 221F to the middle row 226 of offset mating holes 222 on the second base strip 221S. The offset holes in the middle row 226 are marked by "X's" to designate these holes 222.

The two other rows of holes are shown in FIGS. 9C and 9D. When the base strips 221F, 221S are oriented so a user can read the instructions "Match Pegs on Dividers with the Same Letter on Both Bases" printed on each base strip 221F, 221S, the row of offset mating holes 222 closest to the base strip supports 235 has "W's" marked on that row 228. The row of offset mating holes 222 furthest from the supports 235 has "M's" marked on that row 224. The letters may be perceived as either an "M" or a "W" depending on the orientation from which either base strip 221F, 221S is viewed. These two letters, "W" and "M," facilitate the assembly of the disclosed shelf divider system 210. When the first base strip 221F is rotated 180° to become the second base strip 221S, the "W's" and "M's" are reversed. Thus, the notches 245 on the edge of the substantially upside-down "T"-shaped shelf dividers 247 in line with the bottom snap-fit pegs 246 should be matched with the same lettered row on the first and second base strips 221F, 221S. Each base strip and product guard assembly 220F, 220S bears the instructions, "Match Pegs on Dividers with the Same Letter on Both Bases," as shown in FIG. 9B. The matching letters are "W's, X's, or M's." Therefore, the substantially upside-down "T" shaped shelf dividers 247 are staggered, or offset, against the product guard 232F, 232S on the base strips and product guard assemblies 220F, 220S. But the offset distance is not great enough to allow even the smallest of products to leave the designated product organizing channel 212 formed between the shelf dividers 247, 248.

As shown in FIG. 9A, the base strip support 235 connects the first and second base strips 221F, 221S to the first and second product guards 232F, 232S. First and second product guards 232F, 232S are constructed and arranged substantially perpendicular to the first and second base strips 221F, 221S, respectively. At that connection between the first and second base strips 221F, 221S and the first and second product guards 232F, 232S, rectangular slots 236, sized to receive the perpendicular to the first and second base strips 221F, 221S, respectively. At that connection between the first and second base strips 221F, 221S and the first and second product guards 232F, 232S, rectangular slots 236, sized to receive the elongated pull ring 254, are formed. These rectangular slots 236 allow the elongated pull ring 254 to pass under the first product guard 232F and over the first base strip portion 221F of the base strip and product guard assembly 220F positioned near the front edge of the product shelf. When the elongated pull ring 254 passes through the rectangular slot 236 formed between the first product guard 232F and the first base strip 221F, the ring portion 260 of the elongated pull ring 254 can be positioned close to the front edge of the product shelf, as seen in FIG. 7.

Shown on top of the product guard 232F, 232S is a narrow extension channel 238. This narrow extension channel 238 has two purposes. The narrow extension channel 238 on the first product guard 232F allows for the insertion of a product guard extension piece (not shown) to accommodate taller products. The product guard extension piece is simply a flat piece similar to the product guard 184 shown in FIG. 5B, sized to fit within the narrow extension channel 238. The narrow extension channel 238 on the top of the second product guard 232S also serves as a receiver for the reel portion 259 of the biased retractable cord assembly 258 whose use is explained below.

Shown in FIGS. 7, 8A, 8B, 11A and 11B, the carrier system 250 of the shelf divider system 210 for causing products to move across the product shelf between the shelf dividers 247, 248 towards the front edge of the product shelf, has between the shelf dividers 247, 248. When the pair of individual shelf dividers 247, 248 form a product organizing channel 212 through which the "L" shaped product paddle 252 passes, the product paddle 252 causes the product aligned within each product organizing channel 212 to move toward the front edge of the product shelf when a pull force is placed on the elongated pull ring 254 after having been moved to the back edge of the product shelf by the reel portion 259 of the biased retractable cord assembly 258. The product paddle 252 has an enclosed feeder channel 264 underneath the substantially horizontal side 253 of the product paddle 252. The enclosed feeder channel 264 is positioned substantially adjacent to the store shelf to allow the elongated pull ring 254 to slide freely across the product display shelf.

Figure 8A:
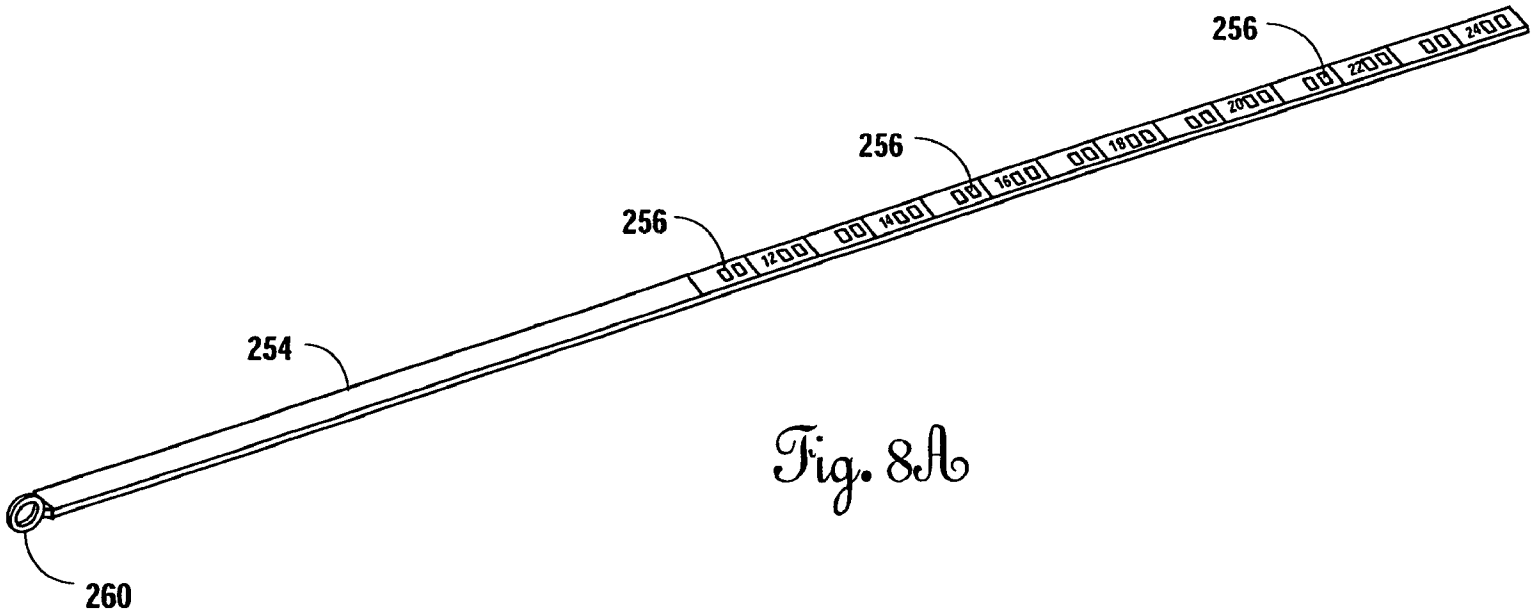
FIG. 8A is a perspective view of the elongated pull ring.
Figure 8B:
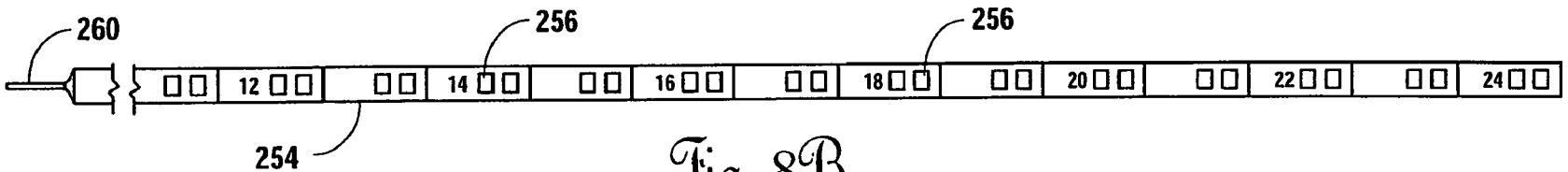
FIG. 8B is a top plan view of the elongated pull ring shown in FIG. 8A.

The elongated pull ring 254 is a narrow strip with a ring 260 on one end, as shown in FIGS. 8A and 8B. The elongated pull ring 254 attaches to the bottom of the substantially "L" shaped product paddle 252 to traverse the first base strip and first product guard assembly 220F and enable movement of the substantially "L" shaped product paddle 252 to the front edge of the first base strip 221F. Numbers located on the elongated pull ring 254 assist users in aligning the bottom of the product paddle 252 on the pull ring 254, as shown in FIGS. 8A and 8B. A user can pull product forward by simply grasping the ring 260 attached to the front of the elongated pull ring 254 and pulling. The ring 260 on the end of the elongated pull ring 254 not only functions as a way to grasp the elongated pull ring 254 to bring product forward; but its design also "teaches" shoppers and product shelf stockers the function of the ring 260 itself. In effect, the ring 260 appeals to the curiosity of a first-time user to demonstrate what will happen when the ring 260 is pulled.

As seen in FIG. 7, the carrier system 250 is assembled as follows: First, that portion of the end of the elongated pull ring 254 opposite the ring 260 is fed through a slot 236 in the base strip and product guard assembly 220F near the front edge of the product shelf. Second, the elongated pull ring 254 is fed through the feeder channel 264 located on the underside of the substantially "L" shaped product paddle 252. Third, one end of a spring clip 266 is attached to the spaced holes 256 on the elongated pull ring 254. The other end of the spring clip 266 is attached to a cord 268 extending from the reel portion 259 of the biased retractable cord assembly 258. The reel portion 259 of the biased retractable cord assembly 258 is attached to the second product guard 232S by clipping the reel portion 259 into the extension channel 238 formed on top of the second product guard 232S extending upwardly from the second base strip 221S.

When the elongated pull ring 254 is manually pulled forward, the spring clip 266 engages the feeder channel 264 on the bottom of the horizontal side 253 of the product paddle 252 to bring products forward through the product organizing channel 212 formed between the shelf dividers 247, 248. When the ring 260 is released, the reel portion 259 of the biased retractable cord assembly 258 causes the elongated pull ring 254 to move back to its starting position, while the product paddle 252 remains in place behind the products stacked in the product organizing channel 212. When the shopper or product shelf stocker needs to again move products forward through the product organizing channel 212, the elongated pull ring 254 is pulled thus causing the product paddle 252 to move forward which in turn brings stated product across the product shelf to the front edge of the product shelf. The shopper or product shelf stocker now has easy access to the product, enabling its selection. The product just behind the product removed from the front edge of the product shelf is now in close proximity to the front edge of the product shelf.

Finally, it should be noted that any product positioned in the product organizing channel 212 formed by the shelf dividers 247, 248 and placed in front of the product paddle 252 will be caused to move forward by the force exerted on the elongated pull ring 254. Also, with the elongated pull ring 254 passing through the slot 236 near the first base strip 221F, the carrier assemblies 250 become an integral part of the shelf divider system 210. No components of the shelf divider system 210 can be removed from the product shelf. Thus, the disclosed product organization and presentation system 210 is a "closed" system.

Shoppers and product shelf stockers will appreciate the disclosed shelf divider systems 110, 210 for the following reasons: maximum use of available shelf space; less product shrinkage or loss; more efficient use of employees; and, improved product accessibility. The disclosed shelf divider systems 110, 210 work regardless of the size and the weight of displayed products. Because the disclosed embodiments of the invention have fewer parts and are much simpler in construction than prior art shelf divider systems, the disclosed product shelf divider system has fewer breakdowns. An added feature of the disclosed invention is that it can be assembled in a workroom or storage location away from the product display shelf on which it is to be used. Once assembled, the completed shelf divider system can be moved as a whole unit to the product shelf, thereby reducing the time that a product display is taken away from the view of potential shoppers. Multiple shelf divider systems provide a product organization and presentation system that can be combined with multiple individual product shelves which are mounted to wall or floor support rack.

While the foregoing invention has been described according to its preferred and alternate embodiments, those of ordinary skill in the art will understand that still other embodiments have been enabled by the foregoing disclosure. Such other embodiments shall fall within the scope and meaning of the appended claims.

What is claimed is:

1. A shelf divider system for use on the top of a product shelf having a front edge and a back edge, said shelf divider system comprising:

a first base strip for positioning near the front edge of the product shelf, said first base strip including a longitudinal axis and a transverse axis substantially perpendicular to said longitudinal axis;

a second base strip for positioning near the rear edge of the product shelf, said second base strip including a longitudinal axis and a transverse axis substantially perpendicular to said longitudinal axis;

said first and second base strips each having a plurality of holes formed therein, said plurality of holes formed into rows substantially parallel to the longitudinal axis of their respective base strip and into columns formed parallel to the transverse axis of their respective base strip, said of the first and second base strips being formed at a substantially acute angle to their respective longitudinal axis;

a pair of individual shelf dividers having snap-fit pegs formed on the undersides thereof;

a first product guard constructed and arranged to be positioned substantially perpendicular to said first base strip;

a second product guard constructed and arranged to be positioned substantially perpendicular to said second base strip;

a carrier system for moving products between said pair of individual shelf dividers towards the front edge of the product shelf, said carrier system including:

a substantially "L" shaped product paddle constructed and arranged for movement between said pair of shelf dividers and contact with the products positioned between said shelf dividers;

an elongated pull ring attached to the bottom of said substantially "L" shaped paddle, said elongated pull ring traversing said first base strip and said first product guard;

a biased retractable cord assembly attached to said second product guard;

a spring clip for attachment of said retractable cord assembly to said elongated pull ring;

whereby said pair of individual shelf dividers form a product organizing channel when mounted on said first and second base strips through which said "L" shaped product paddle passes to move product aligned within said product organizing channel toward the front edge of the product shelf when said product is caused to move to the front edge of the product shelf by said elongated pull ring after having been moved to the back edge of the product shelf by said biased retractable cord assembly.

2. The shelf divider system as defined in claim 1 wherein said first and second base strips have at least three rows of holes formed therein.

3. The shelf divider system as defined in claim 1 wherein said acute angle is from about 45° to about 65°.

4. The shelf divider system as defined in claim 1 wherein the width of said product organizing channel is determined by the positioning of said snap-fit pegs within said holes in said first and second base strips.

5. The shelf divider system as defined in claim 4 wherein said snap-fit pegs have a profile selected from a group including: mushroom-shaped, cardioid cusp-shaped, rounded, tapered, triangular, and squared.

6. The shelf divider system as defined in claim 1 wherein said elongated pull ring passes through a slot in said first product guard.

7. The shelf divider system as defined in claim 1 wherein said first and second base strips include a plurality of sections connectable to one another to form a continuous length of said first and second base strips along the product shelf.

8. A product organization and presentation system for products, comprising:

a plurality of product shelves mounted in a rack, each of said product shelves having a front edge and a back edge;

a system for organizing product on each of said product shelves including:

a first base strip for positioning near the front edge of each product shelf, said first base strip including a longitudinal axis and a transverse axis positioned at an acute angle with respect to said longitudinal axis;

a second base strip for positioning near the back edge of each product shelf, said second base strip including a longitudinal axis and a transverse axis positioned at an acute angle with respect to said longitudinal axis;

said first and second base strips having a plurality of holes formed therein, said plurality of holes formed into rows substantially parallel to the longitudinal axis of their respective base strip and into columns formed parallel to the transverse axis of their respective base strip a plurality of pairs of individual shelf dividers, each individual shelf divider having snap-fit pegs formed on the underside thereof;

a first product guard constructed and arranged to be positioned substantially perpendicular to said first base strip;

a second product guard constructed and arranged to be positioned substantially perpendicular to said second base strip;

a carrier system for moving product between a pair of said individual shelf dividers towards the front edge of the product shelf, said carrier system including:

a substantially "L" shaped product paddle constructed and arranged for movement between said pair of individual shelf dividers by contact with the product positioned between said pair of individual shelf dividers;

an elongated pull ring attached to the bottom of each substantially "L" shaped paddles;

a plurality of biased retractable cord assemblies attached to said second product guard;

a spring clip for attachment of said retractable cord assembly to said elongated pull ring;

whereby said pair of shelf dividers on said product shelf form product organizing channels through which said "L" shaped product paddle passes to cause product aligned within said product organizing channels to move toward the front edge of the product shelf when pulled toward the front edge of said product shelf by said elongated pull ring after having been moved to the back edge of said product shelf by said biased retractable cord assembly.

9. A method for organizing and presenting products on a product display shelf, said method comprising the steps of:

forming a first base strip having a plurality of holes, said plurality of holes formed into rows substantially parallel to the longitudinal axis of said first base strip and into columns formed along a transverse axis of the longitudinal axis of said first base strip, said transverse axis being positioned at a substantially acute angle to said longitudinal axis of said first base strip, placing said first base strip near a front edge of the product display shelf, forming a second base strip having a plurality of holes, said plurality of holes formed into rows substantially parallel to the longitudinal axis of said second base strip and into columns formed along a transverse axis of the longitudinal axis of said second base strip, said transverse axis being positioned at a substantially acute angle to said longitudinal axis of said second base strip, placing said second base strip near a rear edge of product display shelf, positioning a pair of individual shelf dividers substantially perpendicularly to said first and second base strips by an interference connection between snap-fit pegs formed on the bottom of each individual shelf divider into the holes formed in said first and second base strips, positioning a first product guard substantially perpendicular to said first base strip;

positioning a second product guard substantially perpendicular to said second base strip;

attaching a biased retractable cord assembly to said second product guard;

attaching an elongated pull ring to said biased retractable cord assembly with a spring clip, connecting said elongated pull ring to a substantially "L" shaped product paddle configured to pass between said pair of individual shelf dividers.

* * * * *